US009474355B1

(12) United States Patent
Chadwick et al.

(10) Patent No.: US 9,474,355 B1
(45) Date of Patent: Oct. 25, 2016

(54) INTERCHANGEABLE BACKPACK FLAP

(71) Applicants: Troy Chadwick, La Palma, CA (US); Kelly Ann Phelan, Marina Del Rey, CA (US)

(72) Inventors: Troy Chadwick, La Palma, CA (US); Kelly Ann Phelan, Marina Del Rey, CA (US)

( * ) Notice: Subject to any disclaimer, the term of this patent is extended or adjusted under 35 U.S.C. 154(b) by 0 days.

(21) Appl. No.: 14/738,743

(22) Filed: Jun. 12, 2015

(51) Int. Cl.

| | |
|---|---|
| ***A44B 18/00*** | (2006.01) |
| ***A41F 1/00*** | (2006.01) |
| ***A45F 3/04*** | (2006.01) |
| *A45F 3/00* | (2006.01) |

(52) U.S. Cl.
CPC ..... *A45F 3/042* (2013.01); *A41F 1/002* (2013.01); *A44B 18/0003* (2013.01); *A45F 3/04* (2013.01); *A45F 2003/001* (2013.01)

(58) Field of Classification Search
CPC ..... A45F 3/04; A44B 18/00; A41F 1/00
See application file for complete search history.

(56) References Cited

U.S. PATENT DOCUMENTS

| | | | | | |
|---|---|---|---|---|---|
| 4,495,660 | A * | 1/1985 | Hayden | A41D 23/00 | 2/91 |
| 4,573,218 | A * | 3/1986 | Saggs | A41D 15/002 | 2/108 |
| 4,609,084 | A * | 9/1986 | Thomas | A45C 9/00 | 190/110 |
| 4,810,102 | A * | 3/1989 | Norton | A45C 1/04 | 150/108 |
| 4,883,207 | A * | 11/1989 | McArthur | A45F 3/04 | 190/113 |

(Continued)

*Primary Examiner* — Brian D Nash
(74) *Attorney, Agent, or Firm* — James M. Smedley LLC; James Michael Smedley, Esq.

(57) ABSTRACT

The present invention relates to a backpack with a removable decorative flap accessory. More specifically a backpack has a hidden attachment means which allows a decorative backpack flap accessory to be attached to the top of the backpack. When the decorative flap accessory is not used, the attachment means is concealed to preserve aesthetic appeal of the backpack. A lunchbox or other secondary container with a matching decorative flap accessory can also be attached the front of the backpack.

14 Claims, 6 Drawing Sheets

(56) References Cited

U.S. PATENT DOCUMENTS 5,012,964 A * 5/1991 Falletta ..... B63C 11/26 224/153
5,165,111 A * 11/1992 Lieberman ..... A45F 3/04 2/108
5,222,642 A * 6/1993 Solarz ..... A45C 13/08 224/191
5,255,834 A * 10/1993 Bendersky ..... A45C 13/08 206/457
5,326,300 A * 7/1994 Sonders ..... A63H 3/005 190/1
5,573,155 A * 11/1996 Sadler ..... A45F 4/02 224/153
5,649,658 A * 7/1997 Hoffman ..... A45F 3/04 190/2
6,193,118 B1 * 2/2001 Kearl ..... A45C 7/0095 108/43
6,393,745 B1 * 5/2002 Miki ..... G09F 27/00 224/627
2002/0139820 A1 * 10/2002 Godshaw ..... A45F 4/02 224/153
2002/0166881 A1 * 11/2002 Willingham ..... A45C 7/0095 224/652
2004/0143880 A1 * 7/2004 Clark ..... A41D 3/00 2/69
2004/0200871 A1 * 10/2004 Han ..... A45C 13/36 224/576
2005/0045520 A1 * 3/2005 Johnson ..... A45C 11/20 206/542
2005/0133558 A1 * 6/2005 Toombs ..... A45C 13/002 224/576
2008/0277433 A1 * 11/2008 Karl ..... A45F 3/04 224/148.6
2008/0289925 A1 * 11/2008 Sapyta ..... A45C 7/0054 190/109
2009/0180715 A1 * 7/2009 Wittke-Kothe ..... A45F 4/02 383/4
2009/0184143 A1 * 7/2009 Witt ..... A45C 7/0059 224/153
2009/0206118 A1 * 8/2009 Sabbah ..... A45C 13/02 224/652
2009/0294499 A1 * 12/2009 McKinney ..... A45C 13/08 224/576
2010/0112880 A1 * 5/2010 Aschauer ..... A63B 29/021 441/80
2011/0186611 A1 * 8/2011 Eberle ..... A45F 3/04 224/583
2015/0047105 A1 * 2/2015 Fonzo ..... A41F 1/002 2/265
2015/0052657 A1 * 2/2015 Miller ..... A41D 13/0015 2/67

* cited by examiner

INTERCHANGEABLE BACKPACK FLAP

FIELD OF THE INVENTION

The present invention relates to a backpack with a removable decorative flap accessory. More specifically a backpack has a hidden attachment means which allows a decorative backpack flap accessory to be attached to the top of the backpack. When the decorative flap accessory is not used, the attachment means is concealed to preserve aesthetic appeal of the backpack. A lunchbox or other secondary container with a matching decorative flap accessory can also be attached the front of the backpack.

BACKGROUND OF THE INVENTION

Backpacks are ubiquitous in schools from pre-kindergarten through college, graduate school, and even occasionally in professional settings. They come in a variety of shapes colors and designs which allow people to choose a backpack that reflects their personalities or preferences. Styles range from conservative lines with muted colors to eye-catching and stylish designs that demand viewers' attention. Colors and patterns may have no specifically identifiable meaning, or designs may include specific imagery of readily-identifiable cultural phenomena. Typically, a backpack's design or appearance is unalterable, so when a user decides to choose a different style, color or appearance, a new backpack must be purchased, even if the old backpack is still in serviceable condition. This is not a problem as long as backpack styles and designs do not wear out too quickly.

However, backpacks are not immune to the pressures of the fast-paced world of fashion and rapidly changing trends, especially among children and teenagers where the latest video game, pop star, or blockbuster movie might change from month to month. This presents a problem for backpacks, which are fairly durable and can last years or longer before requiring replacement. When it's difficult to tell whether Hannah Montana will still be popular six months from now, one becomes hesitant to purchase a backpack with such a specific and uncertain future social appeal. The risk of embarrassment, when the wave subsides and you're stuck publicly proclaiming your undying affection for Hannah when everyone else has moved on, is just too great. Thus backpacks which have designs and decorations that have broad appeal and don't tie themselves too closely to current trends, became a moderately fashionable, but still safe bet for a purchase that will last into the foreseeable future.

One solution to this problem is to just purchase whatever backpack you want and then purchase a new one if it goes out of style. This unnecessarily produces waste and excess cost which could be avoided if a backpack's unique appearance, which may be focused on a particular celebrity or a summer blockbuster movie theme, could be changed. The present invention seeks to provide a way for backpack and/or lunch box users to change the appearance of their backpacks and/or lunch boxes without having to purchase an entirely new bag. In the case of a backpack, this is done through an interchangeable decorative flap accessory that attaches to the top end of the backpack and hangs down over the front. For the lunchbox, a decorative panel attaches to the lunch box to the front on the left, bottom, and right sides, conveniently forming a functional pocket. The decorative flap accessory can be printed or otherwise decorated with any image or design. For users that want a more conservative look, the flap can be removed entirely from the backpack and the attachment means can be concealed for a clean inoffensive appearance.

In addition, lunch boxes are subject to the very same fashion forces as backpacks, and those that need backpacks often need lunch boxes as well. Lunch boxes also tend to take up a large amount of space in a backpack, leaving less room for books and folders. The present invention also seeks to provide and interchangeable decorative panel for lunch boxes and a way to attach a lunch box to the outside of the backpack, freeing up space inside. The decorative lunch box panel may match the backpack flap or compliment it with a different design or image that matches the theme of the backpack flap.

SUMMARY OF THE INVENTION

Accordingly, it is an object of the present invention to provide a system and method for attaching a decorative flap accessory to a backpack and conceal the decorative flap accessory attachment means when the decorative flap accessory is not used. It is also an object of the present invention to provide a system and method for attaching a decorative panel to a lunchbox and provide a system and method for attaching the lunch box to the outside of a backpack as a fashionable and functional accessory, while freeing up space inside the backpack.

According to an embodiment of the present invention, an attachment mechanism comprises: a base fastener strip comprising a first part A of a two-part attachment mechanism; a concealment flap comprising a part B of the two-part attachment mechanism, wherein the concealment flap is connected at a first side edge of the base fastener strip; wherein the A and B parts of the two-part attachment mechanism are configured to attach to each other so that the concealment flap is capable of attaching to the base fastener strip, hiding from view the two-part attachment mechanism of the base fastener strip and concealment flap; and wherein the concealment flap is configured to fold open in order to expose the first part A and part B of the two-part attachment mechanism for usage.

According to an embodiment of the present invention, the attachment mechanism further comprises: an attachment tongue comprising a second part A of the two-part attachment mechanism, wherein one side of the attachment tongue is connected at a second side edge of the base fastener strip; wherein the attachment tongue and the concealment flap are configured to allow the attachment tongue to fold onto the base fastener strip and allow the concealment flap to attach to the attachment tongue, hiding the two-part attachment mechanism from view; and wherein the attachment tongue is configured to unfold when the concealment flap is unflolded, in order to expose the second part A of the two-part attachment mechanism for usage.

According to an embodiment of the present invention, an apparatus comprises: a first piece comprising a decorative flap accessory which comprises: a visual panel on a front face of the decorative flap accessory, and a first part A of a two-part attachment mechanism on a back face of the decorative flap accessory.

According to an embodiment of the present invention, the apparatus further comprises: a flap securing means placed on the back face, near a bottom end of the decorative flap accessory.

According to an embodiment of the present invention, the apparatus further comprises: a second piece comprising: a base fastener strip comprising a first part B of the two-part attachment mechanism; a concealment flap comprising a second part A of the two-part attachment mechanism, wherein the concealment flap is connected at a first side edge of the base fastener strip; an attachment tongue comprising a second part B of the two-part attachment mechanism, wherein one side of the attachment tongue is connected at a second side edge of the base fastener strip; wherein any part A and any part B of the two-part attachment mechanism are configured to attach to each other; wherein the first piece is configured to attach to the second piece by the first Part A attaching to the second part B while the second part A is configured to attach to the first part B, concealing the base fastener strip from view.

According to an embodiment of the present invention, the second piece further comprises a securing means placed corresponding to a bottom end of the decorative flap accessory such that the bottom end is detachably secured to the second piece According to an embodiment of the present invention, the second piece is a backpack.

According to an embodiment of the present invention, the apparatus further comprises: a first part B of the two-part attachment mechanism on a back face of the decorative flap accessory.

According to an embodiment of the present invention, the apparatus further comprises: a second piece comprising: a base fastener strip comprising a second part B of the two-part attachment mechanism, a concealment flap comprising a second part A of the two-part attachment mechanism, wherein one edge of the concealment flap is connected at a first side edge of the base fastener strip; wherein any part A and any part B of the two-part attachment mechanism are configured to attach to each other; wherein the first piece and the second piece are configured to attach to each other by the first part A of the decorative flap accessory attaching to the second part B of the second piece and the first part B of the decorative flap accessory attaching to the second part A of the second piece.

According to an embodiment of the present invention, the first piece further comprises: a flap securing means placed on the back face, near a bottom end of the decorative flap accessory; the second piece further comprises: a securing means placed corresponding to the bottom end of the decorative flap accessory such that the bottom end is detachably secured to the second piece According to an embodiment of the present invention, the second piece is a backpack.

According to an embodiment of the present invention, a bag comprises: a primary compartment with a primary opening flap; one or more straps for carrying the bag; a base fastener strip comprising a first part A of a two-part attachment mechanism; a concealment flap comprising a first part B of the two-part attachment mechanism, wherein the concealment flap is connected at a first side edge of the base fastener strip; wherein the A and B parts of the two-part attachment mechanism are configured to attach to each other so that the concealment flap is capable of attaching to the base fastener strip, hiding from view the two-part attachment mechanism of the base fastener strip and concealment flap; and wherein the concealment flap is configured to fold open in order to expose the first part A and part B of the two-part attachment mechanism for usage.

According to an embodiment of the present invention, the bag further comprises: a decorative flap accessory comprising: a visual panel on a front face of the decorative flap accessory, a second part A of a two-part attachment mechanism on a back face of the decorative flap accessory; and a second part B of the two-part attachment mechanism on a back face of the decorative flap accessory; wherein the first part A of the base fastener strip is configured to attach to the second part B of the decorative flap accessory and the first part B of the concealment flap is configured to attach to the second part A of the decorative flap accessory.

According to an embodiment of the present invention, the decorative flap further comprises: a flap securing means placed on the back face, near a bottom end of the decorative flap accessory; and the bag further comprises: a securing means placed corresponding to the bottom end of the decorative flap accessory such that the bottom end is detachably secured to the second piece by means of the flap securing means and the securing means.

According to an embodiment of the present invention, the bag further comprises: an attachment tongue comprising a second part A of the two-part attachment mechanism, wherein one side of the attachment tongue is connected at a second side edge of the base fastener strip; wherein the attachment tongue and the concealment flap are configured to allow the attachment tongue to fold onto the base fastener strip and allow the concealment flap to attach to the attachment tongue, hiding the two-part attachment mechanism from view; and wherein the attachment tongue is configured to unfold when the concealment flap is unflolded, in order to expose the second part A of the two-part attachment mechanism for usage.

According to an embodiment of the present invention, the bag further comprises: a decorative flap accessory comprising: a visual panel on a front face of the decorative flap accessory, and a second part B of a two-part attachment mechanism on a back face of the decorative flap accessory; wherein the decorative flap accessory is configured to attach to the bag by the second part B attaching to the second part A.

According to an embodiment of the present invention, the bag wherein the base fastener strip is positioned at the top of the bag between the primary opening flap and the one or more straps.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED SPECIFICATION

The present invention relates to a backpack with a removable decorative flap accessory. More specifically a backpack has a hidden attachment means which allows a decorative backpack flap accessory to be attached to the top of the backpack. When the decorative flap accessory is not used, the attachment means is concealed to preserve aesthetic appeal of the backpack. A lunchbox or other secondary container with a matching decorative flap accessory can also be attached the front of the backpack. An exemplary embodiment will now be explained with reference to the figures.

Figure 1A:
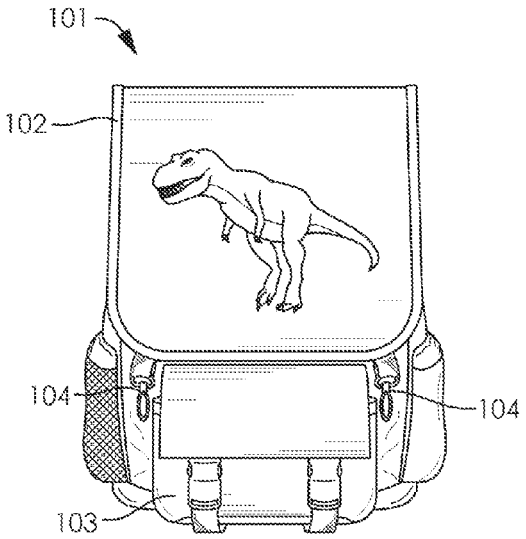
FIG. 1A is a front view of the backpack with the decorative flap accessory attached and visible according to an embodiment of the present invention.
Figure 1B:
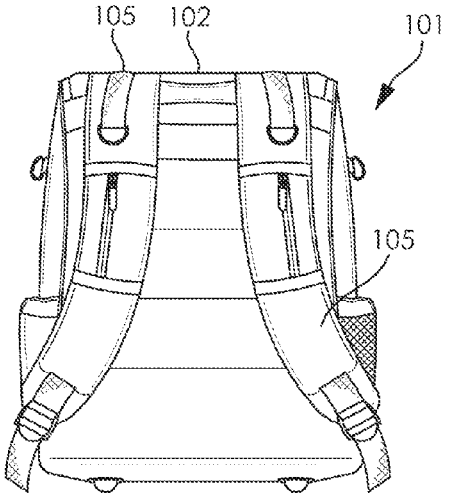
FIG. 1B is a rear view of the backpack with the shoulder straps visible according to an embodiment of the present invention.

FIG. 1A shows an exemplary embodiment of the backpack 101 with a decorative flap accessory 102 attached. According to an embodiment of the present invention, the decorative flap accessory 102 attaches at the top of the backpack 101 and drapes over the front of the backpack covering the main compartment opening, and stopping just above the top of the secondary pocket 103 opening. Two accessory clips 104 are positioned on the front of the backpack below the bottom edge of the decorative flap accessory 102. These accessory clips 104 can be used to attach a lunchbox accessory or some other kind of accessory such as a pencil case, umbrella, fanny pack, water bottle, handbag, etc. The accessory clips 104 and lunchbox accessory will be explained in more detail later. The backside of the backpack 101 is shown in FIG. 1B. The decorative flap accessory 102 attaches to the top of the backpack 101 to avoid interfering with the backpack straps 105.

Figure 2A:
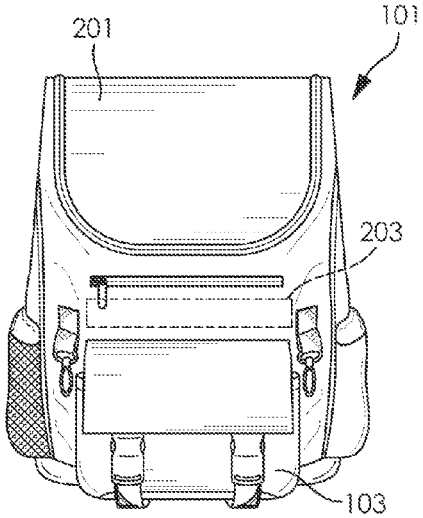
FIG. 2A is a front view of the backpack without the decorative flap accessory attached according to an embodiment of the present invention.
Figure 2B:
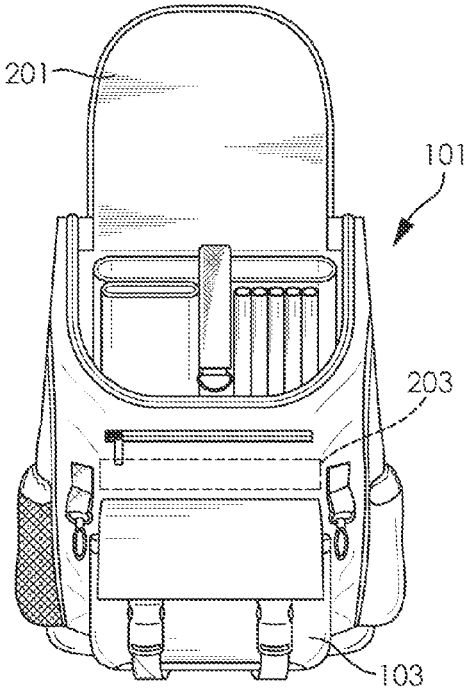
FIG. 2B is a front view of the backpack without the decorative flap accessory attached and with the main compartment open according to an embodiment of the present invention.

FIG. 2A shows the backpack 101 without the decorative flap accessory 102 attached. The main compartment 201 opening remains securely closed even when the decorative flap accessory 102 detached, demonstrating that the decorative flap accessory 102 is not required to function as a closure for backpack 101. FIG. 2B shows a front view of the backpack with the main compartment 201 opened. Because the decorative flap accessory 102 is attached to the top of the bag, it does not interfere with access to the main compartment. The backpack functions as a backpack equally well with or without the decorative flap accessory 102 attached.

According to an embodiment of the present invention, a securing means 203 is placed on top of or under the fabric on the front side of the backpack just above the secondary pocket 103. In FIG. 2*a*, the securing means 203 is a magnetic strip placed under the top layer of fabric. This magnetic strip attaches to a corresponding magnetic strip on the decorative flap accessory 102 and holds it in place when draped over the top of the backpack. This keeps the decorative flap accessory from blowing around in the wind, or waving like a cape when the user is running to catch a bus.

Figure 3A:
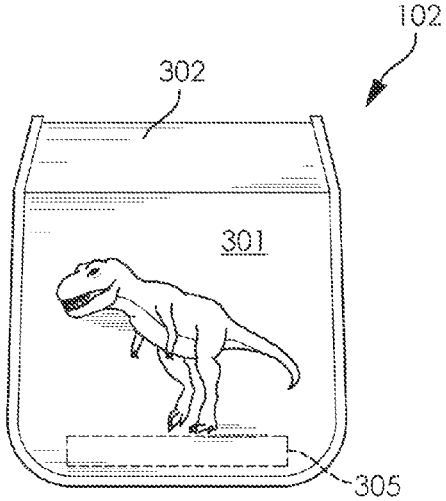
FIG. 3A is a front view of the decorative flap accessory detached from the backpack according to an embodiment of the present invention.
Figure 3B:
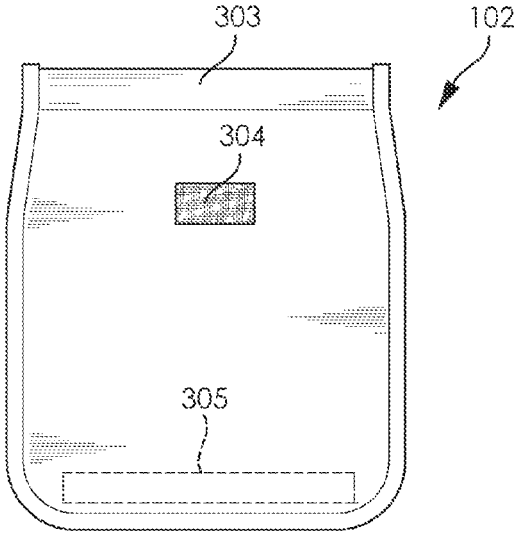
FIG. 3B is a rear view of the decorative flap accessory detached from the backpack, showing the attachment means for attaching the decorative flap accessory to the backpack according to an embodiment of the present invention.

The front and back sides of the decorative flap accessory 102 are shown in FIG. 3A and FIG. 3B respectively. FIG. 3A shows the visual panel 301, which is an area of the decorative flap accessory containing some kind of image, pattern, design, embroidery, embossing, leatherwork, hologram, flexible display, or any other visual element. According to an embodiment of the present invention, the visual panel 301 may also be silk screen printed fabric, a painted portion of fabric, a plastic printed panel attached to the decorative flap accessory, a portion of the decorative flap accessory with decorative stitch work, a holographic panel, a 3D image panel, or any other kind of visual element attached, printed on, or otherwise embodied in the decorative flap accessory. The flap attachment portion 302 is a portion of the decorative flap accessory 102 which may or may not include part of the visual panel 301, but at least comprises some kind of flap-side attachment means. In this embodiment, the flap attachment portion 302 comprises a flap-side hook-and-loop strip 303 which, in this embodiment, is placed on the rear side of the decorative flap accessory 102 shown in FIG. 3B. Referring now to FIG. 3B, the underside of the decorative flap accessory 102 has the flap-side hook-and-loop strip 303 at the top and a small pocket 304 in the middle of the back side.

A flap securing means 305 is placed inside the bottom end of the decorative flap accessory 102 between layers of fabric, or alternatively attached to material on the rear side of the decorative flap accessory 102. According to one embodiment of the present invention, this flap securing means 305 is a corresponding magnetic strip which attaches to the magnetic strip securing means 203 on the backpack 101. The securing means 203 and flap securing means 305 can comprise a magnet and/or a piece of magnetic metal, or two magnets positioned so that they attract each other when the securing means 203 and flap securing means 305 are placed in close proximity to each other.

Figure 4A:
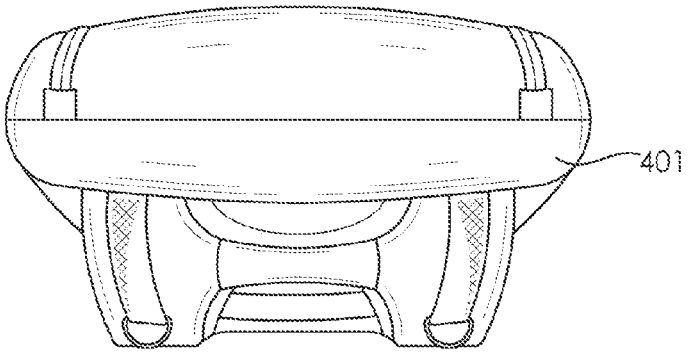
FIG. 4A is a top view of the backpack without the decorative flap accessory attached and with the flap attachment means concealed from view according to an embodiment of the present invention.

One embodiment of the concealable backpack-side attachment means will now be described in detail with reference to FIGS. 4A-4D. FIG. 4A shows the top side of the backpack with the concealing flap 401 covering an attachment tongue 402 (not shown in FIG. 4A) which attaches to the decorative flap accessory 102 (not shown in FIG. 4A) by a strip of hook-and-loop fastener. According to one embodiment of the present invention, the concealing flap 401 matches the material and color of the rest of the backpack.

Figure 4B:
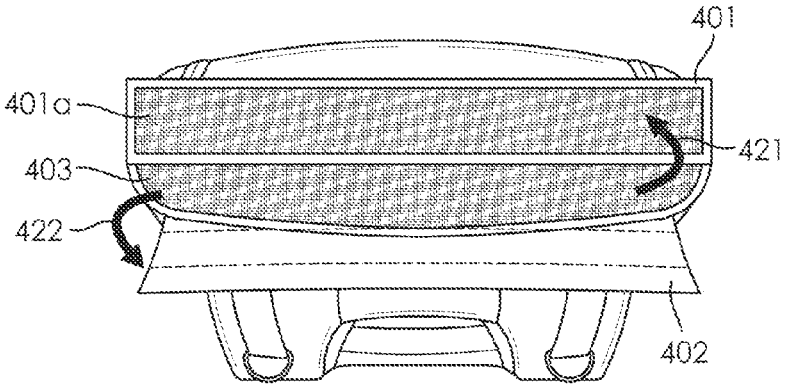
FIG. 4B is a top view of the backpack showing how the attachment means is unfolded in order to attach the decorative flap accessory according to an embodiment of the present invention.

Referring now to FIG. 4B, according to an embodiment of the present invention, the concealing flap 401 lifts up and folds open in the direction of arrow 421, revealing the attachment tongue 402. The attachment tongue 402 unfolds to attach to the decorative flap accessory 102 by means of a strip of hook-and-loop fastener. From the top down view of FIGS. 4B-4D, the strip of hook-and-loop fastener on the attachment tongue 402 is on the underside of the attachment tongue 402. The concealing flap underside (topside when the concealing flap 401 is folded open) also has a concealed attachment means 401*a* which is one part of a two-part attachment system. In this particular embodiment, the two-part attachment system includes a strip of hook-and-loop fastener. When the concealing flap 401 is folded closed over the attachment tongue 402, the concealed attachment means 401*a* attaches to the attachment tongue 402, securing it between the concealing flap 401 and the backpack and concealing it from view.

Once the concealing flap is folded open, the attachment tongue 402 lifts up and folds open in the direction of arrow 422 which is opposite to arrow 421. Unfolding the attachment tongue 402 reveals a base fastener strip 403 which is also a hook-and-loop fastener. The attachment tongue 402 is sewn onto one side edge of this base fastener strip 403, and the concealing flap 401 is sewn onto the opposite side edge so that each side folds over the base fastener strip 403 toward the other side in a tri-fold manner with the attachment tongue 402 lying under the concealing flap 401. In other words, once the base fastener strip 403 is exposed, the concealing flap 401 folds back over in the direction of arrow 423 to attach to the base fastener strip 403. Thus according to one embodiment of the present invention, the backpack-side attachment means comprises the concealing flap 401 with concealed attachment means 401*a*, the attachment tongue 402 and the base fastener strip 403.

According to one embodiment of the present invention, the flap attachment portion 302 and concealed attachment means 401*a* both comprise hook-type portions of a hook-and-loop fastener system, while the base fastener strip 403 and attachment tongue 402 each comprise the loop-type portion of a hook-and-loop fastener system. This allows the concealing flap 401 to attach to both the attachment tongue 402 when it is concealed, and the base fastener strip 403 when the attachment tongue 402 is deployed. This also allows the attachment tongue 403 to attach to both the concealing flap 401, when the attachment tongue is concealed, and the hook-and-loop strip 303 on the flap attachment portion 302 when the decorative flap accessory 102 is attached. Whatever two-part attachment system is used, whether it be hook-and-loop, magnets, buttons, clips, snaps, etc., according to some embodiments, it is important for the concealing flap 401 to be able to attach to the base fastener strip 403.

Figure 4C:
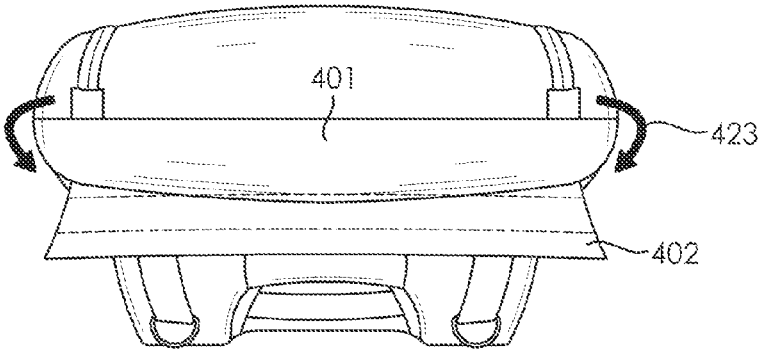
FIG. 4C is a top view of the backpack showing how the attachment means concealment flap is secured back to the backpack once the decorative flap accessory attachment means is unfolded for attaching the decorative flap accessory according to an embodiment of the present invention.
Figure 4D:
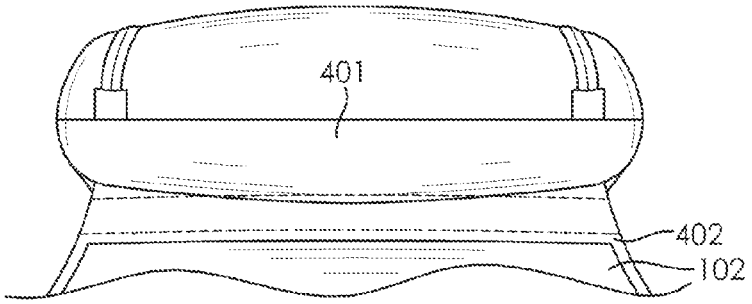
FIG. 4D is a top view of the backpack showing how the decorative flap accessory attaches to the backpack according to an embodiment of the present invention.

Now referring to FIG. 4C, when the attachment tongue 402 is unfolded, leaving the fastener strip 403 exposed, the concealing flap 401 folds back down onto the fastener strip and attaches to the fastener strip, restoring the original look of the backpack (See FIG. 4A) with the exception of the now unfolded and exposed attachment tongue 402. In FIG. 4D, the flap-side hook-and-loop strip 303 (See FIG. 3B) attaches to the hook-and-loop strip on the attachment tongue 402, securing the flap to the backpack. In this manner, the detachable flap can be easily removed and replaced to quickly change the appearance of the backpack.

Figure 5:
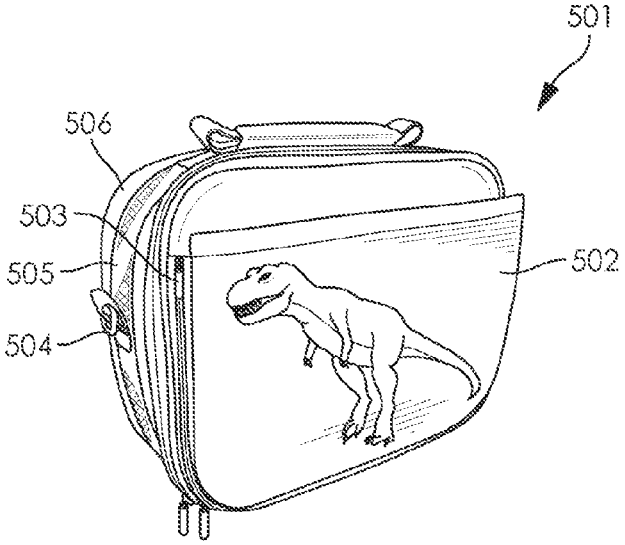
FIG. 5 is a perspective view of the lunchbox accessory with a detachable decorative panel according to an embodiment of the present invention.

FIG. 5 shows a perspective view of a lunchbox 501 accessory with a detachable decorative panel 502. According to one embodiment of the present invention, the decorative panel 502 attaches to the lunchbox 501 by a zipper 503 on three sides of the perimeter of the face of the lunchbox. Two attachment rings 504 are placed along a reinforcement strap 505 that runs around the perimeter sidewalls 506 of the lunch box 501.

Figure 6A:
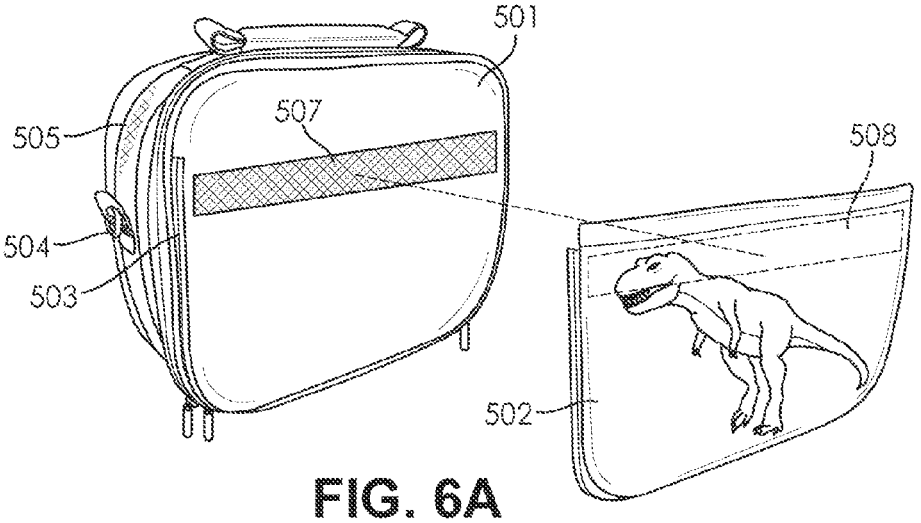
FIG. 6A is a view of the lunchbox accessory with the decorative panel detached according to an embodiment of the present invention.
Figure 6B:
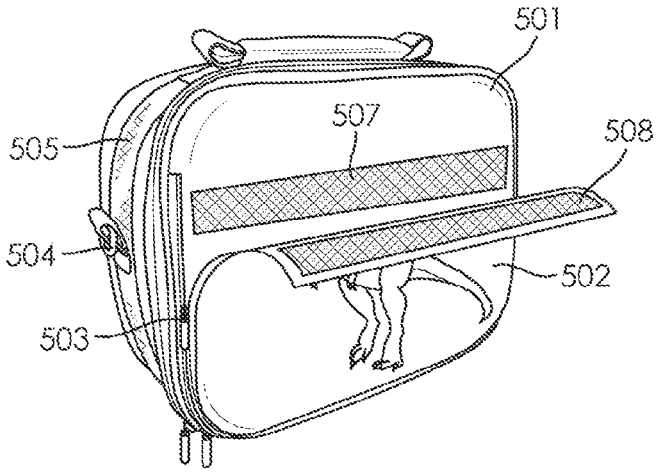
FIG. 6B is a view of the lunchbox accessory with the decorative panel partially zipped on according to an embodiment of the present invention.

Referring now to FIG. 6A, the decorative panel 502 is shown detached from the lunchbox 501 with half of the zipper 503 on the perimeter of the lunchbox 501 face and the corresponding other half of the zipper 503 on the perimeter of the decorative panel 502. According to one embodiment of the present invention, a securing patch 507 of hook-and-loop fastener is also placed on the face of the lunchbox 501 near the top of the decorative panel 502 all the way across on the perimeter edge where there is no zipper 503. When connected to the panel securing patch 508, this securing patch 507 provides closure for a small pocket created between the decorative panel 502 and the lunchbox 501. FIG. 6B shows how the decorative panel 502 zips onto the lunchbox 501. One of the two attachment rings 504 is also shown attached to a reinforcement strap 505.

Figure 7:
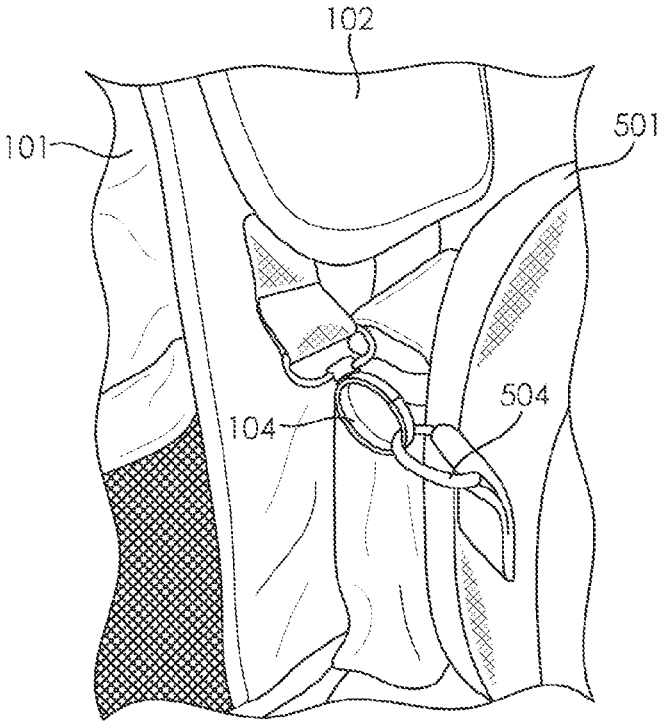
FIG. 7 is a close up view of the accessory attachment means used here to attach a lunchbox accessory to the backpack according to an embodiment of the present invention.
Figure 8:
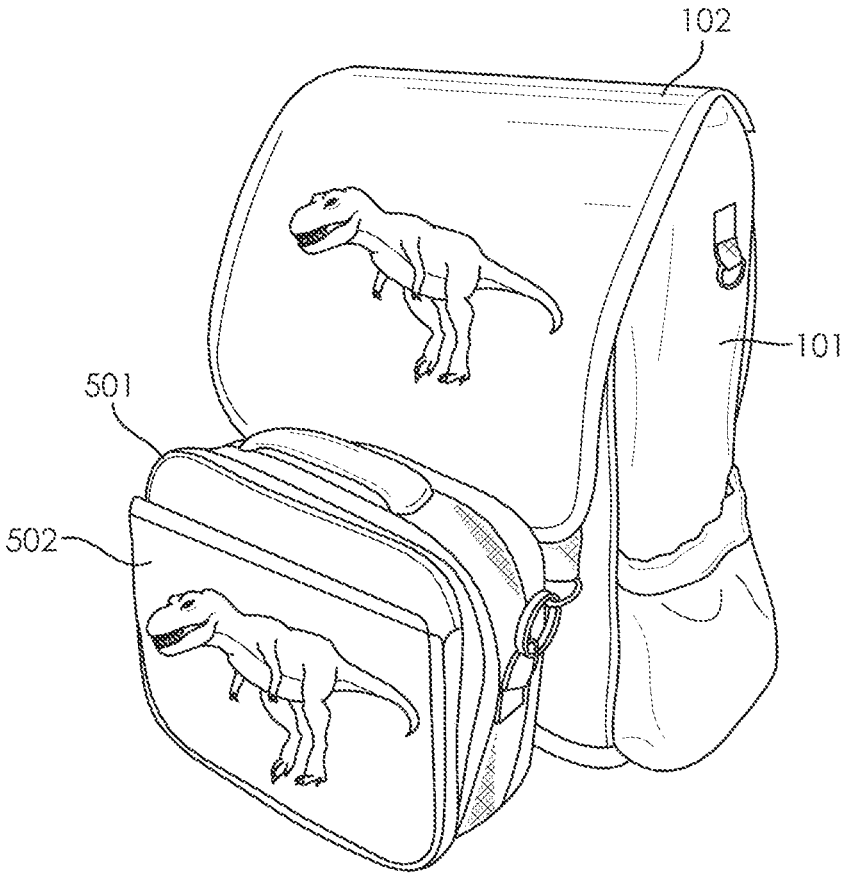
FIG. 8 is a perspective view of the backpack with the decorative backpack flap attached, and the lunchbox accessory including the lunchbox decorative panel also attached to the backpack according to an embodiment of the present invention.

FIG. 7 shows a close-up view of and attachment ring 504 connected to an accessory clip 104 on the backpack. According to an embodiment of the present invention, the accessory attachment means for attaching the lunchbox 501 to the backpack 101 comprises an attachment ring 504 on the lunchbox 501 and a backpack-mounted accessory clip 104 which is a closed loop with a spring-loaded door similar to a carabiner. FIG. 8 shows the decorative flap accessory 102 and the lunchbox 501 accessory both attached to the backpack. The lunchbox has attached a decorative panel 502 that matches the design of the decorative flap accessory 102 on the backpack 101.

According to an alternate embodiment, the backpack-side attachment means is simplified by deleting the attachment tongue 402 shown in FIG. 4B. This leaves the concealing flap 401 with a concealed attachment means 401*a* that attaches directly to the base fastener strip 403 to conceal the backpack-side attachment means from view. When the concealing flap 401 is folded open, both the concealed attachment means 401*a* and the base fastener strip 403 become exposed. In this embodiment, the attachment portion 302 of the decorative flap accessory 102 has a compound attachment means which connects to both the concealed attachment means 401*a* and the base fastener strip 403.

When a hook-and-loop fastener system is used, the compound attachment means will have a hook-type strip called part A, and a loop-type strip called part B. Part A will attach to the base fastener strip 403 and part B will attach to the concealed attachment means 401*a*, while the concealed attachment means 401*a* and the base fastener strip 403 are capable of attaching to each other. Alternatively, part A can be a loop-type and part B can be a hook-type. One of ordinary skill in the art would recognize that it does not matter what type of attachment means is used for the concealed attachment means 401*a*, base fastener strip 403, and compound attachment means, as long as the concealed attachment means 401*a* is capable of attaching to the base fastener strip 403, and the compound attachment means is capable of attaching to both the concealed attachment means 401*a* and the base fastener strip 403.

The backpack of the present invention includes an interchangeable detachable decorative flap accessory that optionally attaches to the top of the backpack without interfering with the function of the shoulder straps. The detachable flap accessory can have any kind of image, design, pattern, or shape and hangs from the top of the backpack over the front, allowing a user to customize the appearance of the backpack. The decorative flap accessory is optional to the user, and is not required to properly close the main compartment of the backpack. This allows the backpack to be used with or without the decoration for both expressive and conservative styles. When the decorative flap accessory is not used, the decorative flap accessory attachment means on the top of the backpack can be concealed from view to preserve the aesthetic appearance of the backpack. An optional accessory, such as a lunch box, can also be attached to the front of the backpack. The lunchbox is also capable of attaching a decorative panel to the front in order to match the decoration theme of the decorative flap accessory.

According to one embodiment the back-pack-side attachment means comprises a concealing flap, attachment tongue, and base fastener strip. According to another embodiment, the attachment means comprises a concealing flap and a base fastener strip (without an attachment tongue) that fasten to each other. According to another embodiment, the attachment tongue is concealed inside a zippered concealment pouch on top of the backpack. Alternatively, the concealment pouch can be closed by a hook and loop fastener, or a set of buttons, clasps, or snaps. The two-part attachment system may be hook and loop, snaps, a magnetic strip, zippers, clasps, buttons, snaps, or any other kind of attachment means. One of ordinary skill in the art would recognize that any attachment means could be used to attach the decorative flap accessory to the backpack without departing from the spirit and scope of the present invention.

In another alternative embodiment, the attachment means for attaching the decorative flap accessory to the backpack is one or more magnets concealed under the outer layer of fabric covering the backpack and the decorative flap accessory has one or more corresponding magnets to attach to the concealed magnets. In another alternate embodiment, the attachment means is concealed by decoration, such as a row of decorative buttons which attach to button holes on the decorative flap accessory, a set of decorative magnets on the outer layer of fabric, or a set a laces and lace eyelets on both the backpack and the backpack flap.

According to one embodiment of the invention, the securing means 203 and flap securing means 305 can be replaced with a buckle component at the end of the decorative flap accessory, which secures the flap to the backpack by way of a corresponding attachment means on the backpack. Alternatively, a hook-and-loop fastening system, buttons, snaps, clasps, zippers, or any other securing means may be used without departing from the spirit and scope of the present invention.

According to another embodiment of the present invention, the concealment flap is attached to one of the sides of the base fastener strip that is not opposite the attachment tongue. The operation of the concealment flap would remain the same, lifting up to release the attachment tongue and reattaching to the base fastener strip underneath the attachment tongue. The attachment tongue then hangs free to attach to the decorative flap accessory.

According to an alternate embodiment of the present invention, the securing patch 507 and panel securing patch 508 of hook-and-loop fastener may cover only a portion of the top edge of the decorative panel 502, or may be divided into multiple parts. One of ordinary skill in the art would recognize that the securing patch 507 and panel securing patch 508 need not extend continuously entirely across the top edge of the decorative panel 502. Alternatively the securing patch 507 and panel securing patch 508 may be replaced by extending the zipper from the side all the way around the top of the decorative panel 502. The zipper could then be partially unzipped in order to provide access to the pocket created between the lunch box 501 and the decorative panel 502. Alternatively, one of ordinary skill in the art would recognize that the securing patch 507 and panel securing patch could be replaced with buttons, snaps, magnetic closures, or any other securing means, or leave the opening unsecured without departing from the spirit and scope of the present invention.

In an alternative embodiment, the securing patch 507 may be replaced with a concealed attachment means similar to the backpack-side attachment means that was simplified by deleting the attachment tongue 402. Thus, the securing patch 507 would operate similar to the base fastener strip 403, and a lunchbox concealing flap would cover and attach to the securing patch 507 when the decorative panel 502 is not used. This creates a visible fold on the face of the lunchbox while hiding the securing patch 507 when a decorative panel is not used. When a decorative panel 502 is placed on the lunch box, it is unnecessary to secure the decorative panel 502 to the securing patch 507 via the panel securing patch 508, but a panel attachment means on the front of the decorative panel 502 allows the lunchbox concealing flap to fold over the top edge (the edge without a zipper) of the decorative panel, and attach to the panel attachment means, securing the panel to the lunchbox and closing the pocket created between the lunchbox and the decorative panel 502.

Alternatively, a decorative panel that matches the plain material of the face of the lunchbox could be placed on the lunchbox in the same manner as the decorative panel with an image or some other kind of pattern design. This would eliminate a need for a concealed attachment means, hide the securing patch 507 from view, and provide a conservative appearance when an image or other pattern design in not desired.

According to an embodiment of the present invention, the attachment ring 504 and accessory clip 104 are replaced by a hook-and-loop fastener, a buckle system, buttons, snaps, spiral rings, or any kind of attachment means. One of ordinary skill in the art would recognize that any kind of attachment means may be used in place of the accessory clip 104 and the attachment ring 504 without departing from the spirit and scope of the present invention.

According to an embodiment of the present invention, the backpack has a set of wheels on the bottom edge on the back side of the backpack where the straps are attached. In addition, a telescoping handle is at the top of the backpack. When the telescoping handle is extended, it allows the backpack to be tipped toward the edge where the wheels are placed and rolled like a piece of luggage. To prevent the straps from dragging on the ground when the backpack is used in this rolling mode, the backpack also has a strap restraining mechanism. The strap restraining mechanism holds the straps away from the ground, or allows the straps to be tucked away out of sight in a pocket on the back pack.

While the invention has been thus described with reference to the embodiments, it will be readily understood by those skilled in the art that equivalents may be substituted for the various elements and modifications made without departing from the spirit and scope of the invention. It is to be understood that all technical and scientific terms used in the present invention have the same meaning as commonly understood by one of ordinary skill in the art to which this invention belongs. Accordingly, the drawings and descriptions are to be regarded as illustrative in nature and not restrictive.

The invention claimed is:

1. An attachment mechanism comprising:

(1) a base fastener strip comprising a first part A of a two-part attachment mechanism;

(2) a concealment flap comprising a part B of the two-part attachment mechanism, wherein said concealment flap is connected at a first side edge of the base fastener strip;

wherein said A and B parts of the two-part attachment mechanism are configured to attach to each other so that an attachment means affixed on an underside of said concealment flap mates with said base fastener strip, so that only a topside of said concealment flap is visible; and wherein said concealment flap is configured to fold open in order to expose the first part A and part B of the two-part attachment mechanism for usage;

(3) an attachment tongue comprising a second part A of the two-part attachment mechanism, wherein one side of the attachment tongue is connected at a second side edge of the base fastener strip;

wherein said attachment tongue and said concealment flap are configured to allow the attachment tongue to fold onto the base fastener strip and allow the attachment means to cover, and attach to, the attachment tongue, thereby hiding the two-part attachment mechanism from view; and wherein said attachment tongue is configured to unfold when said concealment flap is unfolded, in order to expose said second part A of the two-part attachment mechanism for usage.

2. An apparatus comprising:

a first piece comprising a decorative flap accessory which comprises:

a visual panel on a front face of said decorative flap accessory, and a first part A of a two-part attachment mechanism on a back face of said decorative flap accessory;

a second piece comprising:

a base fastener strip comprising a first part B of the two-part attachment mechanism;

a concealment flap comprising a second part A of the two-part attachment mechanism, wherein said concealment flap is connected at a first side edge of the base fastener strip;

an attachment tongue comprising a second part B of the two-part attachment mechanism, wherein one side of the attachment tongue is connected at a second side edge of the base fastener strip;

wherein any part A and any part B of the two-part attachment mechanism are configured to attach to each other;

wherein the first piece is configured to attach to the second piece by the first Part A attaching to the second part B while the second part A is configured to attach to the first part B, concealing the base fastener strip from view.

3. The apparatus of claim 2 further comprising:

a flap securing means placed on the back face, near a bottom end of said decorative flap accessory.

4. The apparatus of claim 2 wherein said second piece further comprises a securing means placed corresponding to a bottom end of said decorative flap accessory such that said bottom end is detachably secured to said second piece.

5. The apparatus of claim 2 wherein said second piece is a backpack.

6. The apparatus of claim 2 further comprising:

a first part B of the two-part attachment mechanism on a back face of said decorative flap accessory.

7. An apparatus comprising:

a first piece comprising a decorative flap accessory which comprises:

a visual panel on a front face of said decorative flap accessory, and a first part A of a two-part attachment mechanism on a back face of said decorative flap accessory;

a first part B of the two-part attachment mechanism on a back face of said decorative flap accessory; and a second piece comprising:

a base fastener strip comprising a second part B of the two-part attachment mechanism, a concealment flap comprising a second part A of the two-part attachment mechanism, wherein one edge of said concealment flap is connected at a first side edge of the base fastener strip;

wherein any part A and any part B of the two-part attachment mechanism are configured to attach to each other, wherein said first piece and said second piece are configured to attach to each other by the first part A of the decorative flap accessory attaching to the second part B of the second piece and the first part B of the decorative flap accessory attaching to the second part A of the second piece.

8. The apparatus of claim 7 wherein:

said first piece further comprises:

a flap securing means placed on the back face, near a bottom end of said decorative flap accessory;

said second piece further comprises:

a securing means placed corresponding to the bottom end of said decorative flap accessory such that said bottom end is detachably secured to said second piece.

9. The apparatus of claim 7 wherein said second piece is a backpack.

10. A bag comprising:

a primary compartment with a primary opening flap;

one or more straps for carrying the bag;

a base fastener strip comprising a first part A of a two-part attachment mechanism;

a concealment flap comprising a first part B of the two-part attachment mechanism, wherein said concealment flap is connected at a first side edge of said base fastener strip and compromises of an attachment means on an underside;

wherein said A and B parts of the two-part attachment mechanism are configured to attach to each other so that the attachment means of said concealment flap mates with said base fastener strip so that only a topside of said concealment flap is visible; and wherein said concealment flap is configured to fold open in order to expose the first part A and part B of the two-part attachment mechanism for usage;

a decorative flap accessory comprising:

a visual panel on a front face of said decorative flap accessory, a second part B of the two-part attachment mechanism on a back face of said decorative flap accessory; and wherein said first part A of the base fastener strip is configured to attach to the second part B of the decorative flap accessory and the first part B of the concealment flap is configured to attach to the second part A of the decorative flap accessory.

11. The bag of claim 10 wherein:

said decorative flap further comprises:

a flap securing means placed on the back face, near a bottom end of said decorative flap accessory; and said bag further comprises:

a securing means placed corresponding to the bottom end of said decorative flap accessory such that said bottom end is detachably secured to said second piece by means of the flap securing means and the securing means.

12. The bag of claim 10 further comprising:

an attachment tongue comprising a second part A of the two-part attachment mechanism, wherein one side of the attachment tongue is connected at a second side edge of the base fastener strip;

wherein said attachment tongue and said concealment flap are configured to allow the attachment tongue to fold onto the base fastener strip and allow the concealment flap to attach to the attachment tongue, hiding the two-part attachment mechanism from view; and wherein said attachment tongue is configured to unfold when said concealment flap is unfolded, in order to expose said second part A of the two-part attachment mechanism for usage.

13. The bag of claim 12 further comprising:

a decorative flap accessory which comprises:

a visual panel on a front face of said decorative flap accessory, and a second part B of a two-part attachment mechanism on a back face of said decorative flap accessory;

wherein said decorative flap accessory is configured to attach to said bag by the second part B attaching to the second part A.

14. The bag of claim 10 wherein the base fastener strip is positioned at the top of the bag between the primary opening flap and the one or more straps.

* * * * *